United States Patent [19]

Brull et al.

[11] Patent Number: 4,898,487

[45] Date of Patent: Feb. 6, 1990

[54] PRINT HEAD CARRIAGE FOR MATRIX PRINTER

[75] Inventors: Robert A. Brull, Dryden; James R. Del Signore, II, Trumansburg; Alan H. Walker, Barton, all of N.Y.

[73] Assignee: NCR Corporation, Dayton, Ohio

[21] Appl. No.: 282,226

[22] Filed: Dec. 8, 1988

[51] Int. Cl.[4] ..... B41J 11/22

[52] U.S. Cl. ..... 400/354

[58] Field of Search ..... 400/352–354

[56] References Cited

U.S. PATENT DOCUMENTS

| | | | |
|---|---|---|---|
| 4,222,673 | 9/1980 | Plaza | 400/352 X |
| 4,452,542 | 6/1984 | Akazawa | 400/175 |
| 4,795,284 | 1/1989 | Yumoto | 400/352 |

FOREIGN PATENT DOCUMENTS

| | | | |
|---|---|---|---|
| 202871 | 11/1986 | European Pat. Off. | 400/352 |
| 69058 | 4/1983 | Japan | 400/352 |
| 103781 | 6/1984 | Japan | 400/352 |

*Primary Examiner*—Eugene H. Eickholt

*Attorney, Agent, or Firm*—Wilbert Hawk, Jr.; Albert L. Sessler, Jr.; George J. Muckenthaler

[57] ABSTRACT

A print head is secured to a print head carriage and movable along guide rails in printing operation. The carriage includes bearings engaging the guide rails which are secured to the frame of the printer. The print head carriage is made of conductive material to enable bonding of the print head through the carriage and the bearings and along the guide rails to the ground potential of the printer.

4 Claims, 4 Drawing Sheets

PRINT HEAD CARRIAGE FOR MATRIX PRINTER

BACKGROUND OF THE INVENTION

In the field of printing, the most common type printer has been the printer which impacts against record media that is caused to be moved past a printing line or line of printing. As is well-known, the impact printing operation depends upon the movement of impact members, such as print hammers or wires or the like, which are typically moved by means of an electromechanical drive system and which system enables precise control of the impact members.

In the field of dot matrix printers, it has been quite common to provide a print head which has included therein a plurality of print wire actuators or solenoids arranged or grouped in a manner to drive the respective print wires a very short, precise distance from a rest or non-printing position to an impact or printing position. The print wires are generally either secured to or engaged by the solenoid plunger or armature which is caused to be moved such precise distance when the solenoid coil is energized and wherein the plunger or armature normally operates against the action of a return spring.

It has also been quite common to provide an arrangement or grouping of such solenoids in a circular configuration to take advantage of reduced space available in the manner of locating the print wires in that specific area between the solenoids and the front tip of the print head adjacent the record media. In this respect, the actuating ends of the print wires are positioned in accordance with the circular arrangement and the operating or working ends of the print wires are closely spaced in vertically-aligned manner adjacent the record media. The availability of narrow or compact actuators permits a narrower or smaller print head to be used and thereby reduces the width of the printer because of the reduced clearance at the ends of the print line. The print head can also be made shorter because the narrow actuators can be placed in side-by-side manner closer to the record media for a given amount of wire curvature.

In the wire matrix printer which is utilized for receipt and for journal printing operations, the print head structure may be a multiple element type and may be horizontally disposed with the wire elements aligned in a vertical line and supported on a print head carriage which is caused to be moved or driven in a horizontal direction for printing in line manner across the receipt or journal paper and wherein the drive elements or transducers may be positioned in a circular configuration with the respective wires leading to the front tip of the print head. In the wire matrix printer which is utilized for business forms or like record media printing operation, the print head may be oriented in a manner wherein the nose is pointed downward for printing on the form, slip or like media while the carriage and print head are moved above and across the form or media in the horizontal direction.

In the dot matrix printer, there is a requirement for one or more small electric motors to drive certain parts of the printer. A small motor is used to drive the print head carriage in reciprocating manner in the printer that includes a stationary platen and a movable print head. The print head carriage and the associated print head are moved to appropriate and precise locations along the line of printing for dot matrix printing of alpha numeric characters or of graphics type characters. A second motor is used to drive the paper such as a receipt, a slip or a journal at the end of the printing operation and which paper drive is usually performed at the ends of the lines of printing.

Another requirement in a dot matrix printer is to provide means for bonding certain parts of the printer to a ground potential. Ground potential is defined as the chassis of an appropriately-connected integrated or a remote control unit providing electrical power to the dot matrix printer. In printing operations, the printer must be designed to provide static discharge control in order to dissipate the build-up of static charge resulting from the printing impact or electrostatic charge from human contact. In this respect, it is essential that the print head be connected by conductive means to a grounding part of the overall system. The bonding of the print head effectively provides for electrostatic discharge of any charges that may accumulate on the print head. The print head is accessible to the printer operator and therefore needs to be effectively bonded to the grounding system. Tinsel, grounding straps and the like have been used to directly connect the print head to ground potential.

Representative documentation in the field of dot matrix printers includes U.S. Pat. No. 4,452,542, issued to H. Akazawa on June 5, 1984, which discloses a print head carriage with an electrically conductive board connected to the printer frames for grounding the print head.

SUMMARY OF THE INVENTION

The present invention is directed to a dot matrix printer including a printer grounding system. More particularly, the invention includes a mechanism for moving a print head carriage to precise positions along a line of printing during printing operations. The printer includes a bi-directional stepper motor supported at the right-hand side of the printer for driving an endless toothed belt that is coupled to a first or motor pulley and is coupled to a second pulley spaced across the printer from the motor pulley. The endless toothed belt is secured or connected to the carriage that supports the print head which is moved across the printer in an arrangement to provide bi-directional printing.

The second pulley is supported and is journaled at the left side of the printer and is a part of a gear pulley arrangement (or pulley gear configuration) that is provided to drive the inking ribbon for the printer.

The print head carriage is of unitary construction and includes a plurality of bearings which ride along guide rails or shafts of the printer. The guide shafts are attached to the molded frame of the printer by means of snap-in bearing mounts and the carriage is moved by means of the electric stepper motor in transverse direction.

The dot matrix print head is supported on and rigidly secured to the carriage and includes a plurality of actuating coils for driving print wires in printing operation as the print head and carriage assembly are moved back and forth across the printer.

The print head carriage is made of conductive material and includes carbon as an ingredient thereof. The carriage includes the bearings that ride along at least one of the guide rails or shafts and the bearings include brass inserts or sleeves that contact the metallic rail or shaft. The rail or shaft is connected to the grounding portion of the printer by means of straps or like conductive elements. In this regard, the print head is bonded to the grounding system of the printer through the conductive material of the print head carriage.

In accordance with the present invention, there is provided a print head carriage for use in a printer that includes a frame, a print head secured to the carriage, a shaft for carrying the carriage and connected to the printer frame, the carriage including bearing means slidable on the shaft and the carriage being made of conductive material wherein the print head is bonded to the printer grounding system.

In view of the above discussion, a principal object of the present invention is to provide a carriage of conductive material in a dot matrix printer.

Another object of the present invention is to provide a conductive material carriage having a print head secured thereto and connected to the grounding system of the printer for bonding of the print head.

An additional object of the present invention is to provide a carriage made of conductive material and carrying the print head and connected through a supporting shaft to the printer grounding system for bonding of the print head.

A further object of the present invention is to provide a carriage made of conductive material that includes carbon as an ingredient thereof and of sufficient amount to effectively bond the print head that is secured to the carriage.

Additional advantages and features of the present invention will become apparent and fully understood from a reading of the following description taken together with the annexed drawing.

DESCRIPTION OF THE PREFERRED EMBODIMENT

Prior to describing the structure in detail, it should be noted that the printer of the present invention is a multifunction type that can accommodate a receipt, a journal and a slip or form which form consists of one or more parts. The printer can be set in one of five different modes of operation which include printing a journal only, printing a receipt only, printing a receipt and a journal, printing a slip or form only, or printing a slip or form and a journal. The journal and the receipt can accommodate 42 columns of printing and the slip or form can accommodate 46 columns of printing. The printer is connected to a controlling device which contains a power supply whose negative secondary voltage terminals are connected to ground potential, i.e. chassis.

Figure 1:
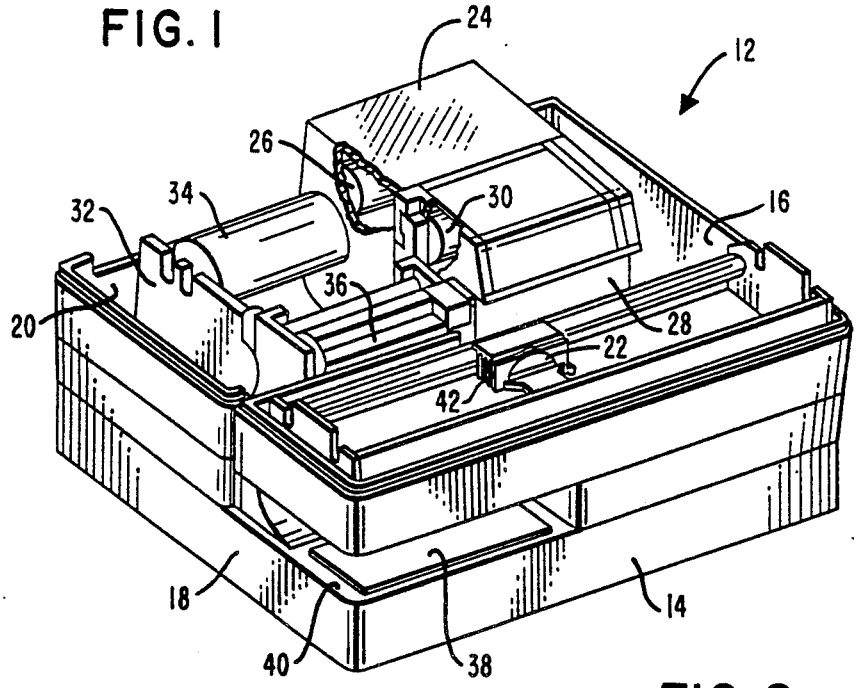
FIG. 1 is a perspective view of a printer incorporating the subject matter of the present invention.

Referring now to the drawing, FIG. 1 shows a perspective view of a printer 12 incorporating the structure of the present invention and having a front portion 14, a right side 16, a left side 18, and a rear portion 20. A wire matrix print head 22 is moved in a side-to-side manner by suitable motor drive means (FIG. 3) located at the right front corner of the printer 12. A journal station or module 24 is provided at the right side of the printer and includes a supply roll 26 of journal paper that is guided past the journal print station platen 28 and is rewound on a take-up roller 30 by a step-type drive motor (not shown).

A receipt station or module 32 is provided at the left side of the printer 12 and includes a supply roll 34 of receipt paper that is guided past the receipt print station platen 36 and is driven by a step-type drive motor (not shown). The journal station 24 and the receipt station 32 are separated by a preferred number (19) of character spaces. A ribbon cassette (not shown) of the operator-changeable type is positioned to the rear of the print head 22 (toward the viewer of the illustration in FIG. 1) and the ribbon is driven in one direction from right to left in a path between the front portion of the print head 22 and the record media (journal, receipt or slip). A slot 40 is provided at the left front side of the printer 12 for insertion of a slip 38 which can be inserted from the front of the printer 12 or from the side thereof in a path in front of the receipt paper at the receipt station 32. A heat sink 42 is provided for the print head 22 to dissipate heat therefrom.

Figure 2:
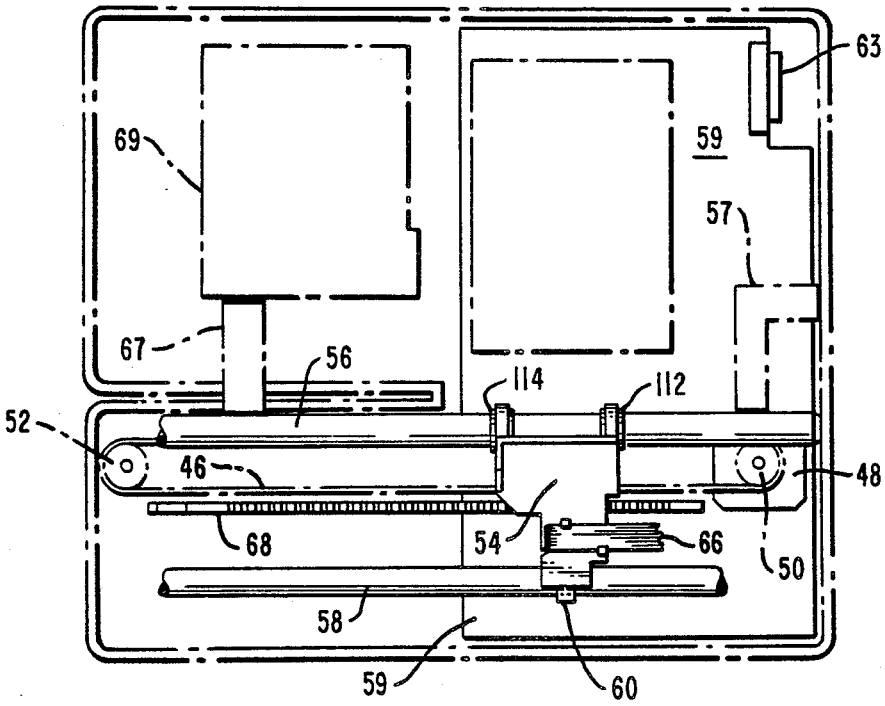
FIG. 2 is a plan view of the printer showing the relative positions of the pertinent parts.
Figure 3:
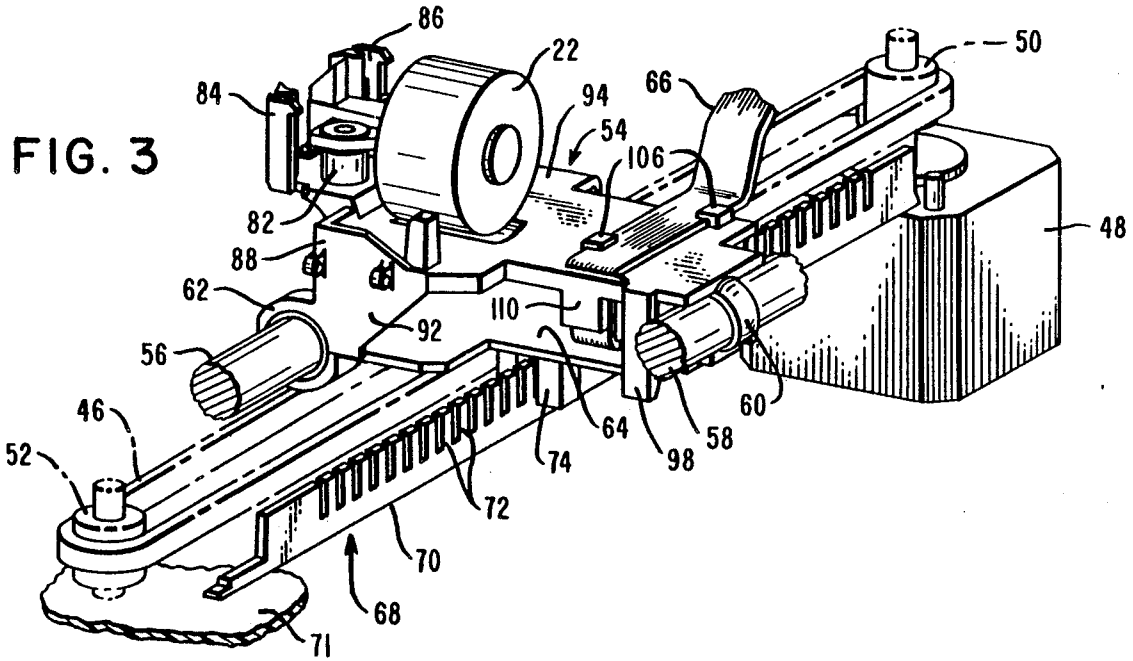
FIG. 3 is an enlarged perspective view of pertinent parts of the printer.
Figure 4:
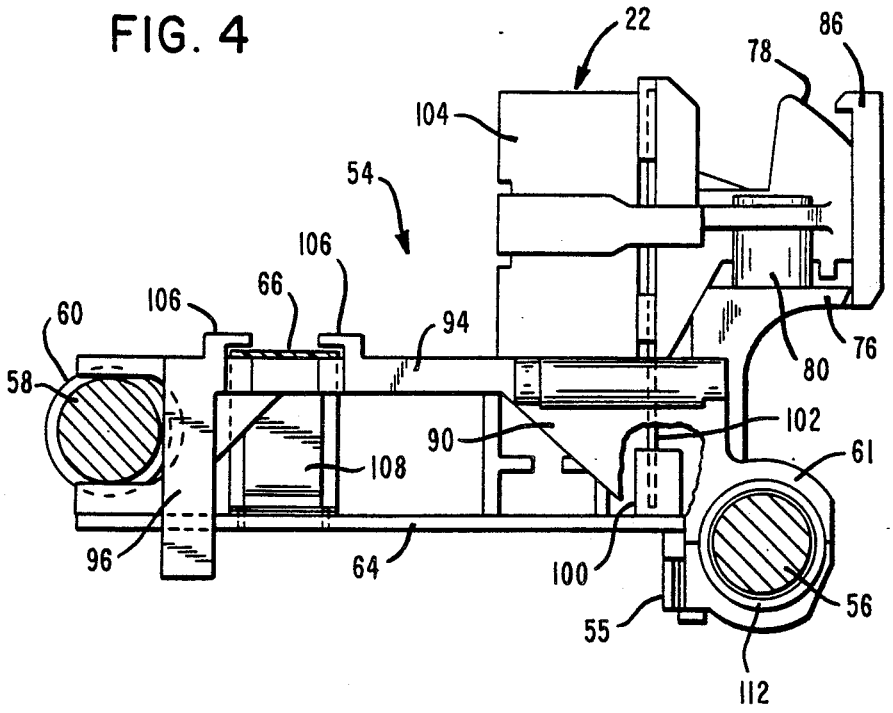
FIG. 4 is a side elevational view of a portion of the printer and showing the arrangement of the print head, the print head carriage, and the supporting shafts.

FIGS. 2 and 3 illustrate the drive mechanism of the present invention wherein an endless toothed belt 46, driven by the print head carriage motor drive means in the form of a stepper motor 48, is trained around a first or motor pulley 50. The motor pulley 50 is secured to and extends upwardly from the stepper motor 48. The endless toothed belt 46 is trained around a second pulley 52 at the left side of the printer 12. A print head carriage 54 is secured by means of a curved or arcuate connector 55 (FIG. 4) to the timing belt 46 to move the carriage 54 back and forth across the printer in bi-directional printing operations. The carriage 54 supports the print head 22 in precise position for printing on the journal, the receipt, or the slip, as the case may be. The carriage 54 is supported by and rides on guide rails or shafts 56 and 58 (FIG. 2) by means of bearings 60, 61 and 62 (FIGS. 3 and 4). Bearing 60 is a front bearing (looking from the front of the printer 12 in FIG. 1) and bearings 61 and 62 are rearward of bearing 60. The carriage 54 is molded from conductive plastic for satisfactory EDS (electrostatic discharge) performance and for static charge control.

The carriage 54 includes a printed circuit board 64 as a part thereof which is connected to a ribbon-style cable 66. The cable 66 is connected to power and control devices in the form of additional printed circuit boards (not shown) coupled to printer control means or a printer controller providing a specific control program for operating the printer 12. The solenoids (not shown) for operating the wires of the print head 22 are connected to the printed circuit board 64 and to the cable 66.

A timing strip 68 of elongated structure and made of plastic material is molded as an integral part of the frame portion 71 of the printer 12. This construction provides that the timing strip 68 is secured and fixed in one position on the printer 12 and is not subject to movement or to adjustment. The timing strip 68 includes a lower solid portion 70 and a plurality of slots 72 facing upwardly and extending substantially along the length of the timing strip 68.

An optical sensor 74 of the light emitting diode and phototransistor type is secured to the underside of the carriage 54 and straddles the timing strip 68. Output signals from the optical sensor 74 are transmitted therefrom to the ribbon cable 66 and to the printer controller.

FIG. 4 shows a side elevational view of the print head carriage 54 supporting the print head 22. The front of the printer 12 is shown at the left in FIG. 4. The print head 22 is shown as being rigidly secured to the carriage 54, however, the print head is removable or easily replaced in the practice of the present invention. The carriage 54 includes the bearing means in the form of the pair of rear bearings 61 and 62 (FIGS. 3 and 4) that are supported by and move along the main guide rail or supporting shaft 56. The front bearing 60 is a spherical bearing and provides a journal and support for the guide rail or supporting shaft 58 that is parallel to the shaft 56. The guide rail or supporting shaft 56 is supported in suitable manner from side frames of the printer 12 (FIG. 2). The shaft 58 is electrically floating and is likewise supported from side frames of the printer 12.

The print head carriage 54 is a molded part which is made of a conductive material and is of unitary construction and of a complex shape to accommodate the many functions that the carriage is required to perform. The carriage includes a nose or front portion 76 of generally plate-like shape to support the nose portion 78 of the print head 22. The nose portion 76 of the carriage 54 includes a pair of spaced hubs 80 and 82 for receiving and securing the print head 22. A pair of projections 84 and 86 at the front of the nose portion 76 of the carriage 54 serve to guide the print head 22 when installing the print head and to maintain the nose portion 76 in position on the carriage. An upright plate portion 88 of the carriage 54 supports the nose portion 76 and connects a pair of bridging portions 90 and 92 that are integral with the rear bearings 61 and 62. The bridging portions 90 and 92 are integral with and connect with a generally horizontal plate portion 94 of the carriage 54, the plate portion providing an opening therein between the bridging portions 90 and 92 for receiving a lower portion of the print head 22.

The carriage 54 also includes a pair of downwardly extending arms 96 and 98 (FIGS. 3 and 4) which support the printed circuit board 64 (FIG. 3) that provides electrical power to the print head 22.

The printed circuit board 64 includes a receptacle or like device 100 (FIG. 4) secured to the top of the board for receiving a printed circuit card 102 of the print head 22. The receptacle 100 is permanently affixed to the end of the board 64. The printed circuit card 102 is sandwiched between the nose portion 78 and the coil portion 104 of the print head 22.

The carriage 54 has a plurality of lugs or guides 106 integral with the plate portion 94 and spaced thereacross for the purpose of routing the flat, flexible cable 66 (FIGS. 2, 3 and 4). The cable 66 is also permanently affixed to the printed circuit board 64, as seen in FIG. 4, and is trained through a passageway formed by a clamp or like element 108 and a guide or like element 110, both integrally formed or molded as a part of the carriage 54. The cable 66 is trained in a suitable path across the top of the plate portion 94 of the carriage 54 to a power source or like connection.

In accordance with the present invention, the carriage 54 is made of a conductive material that eliminates the need for a separate bonding strap or like element for direct connection to and grounding of the print head 22. The carriage 54 preferably is made of molded plastic polycarbonate with 15% teflon polytetrafluoroethylene and 30% carbon fiber/material, as manufactured by RTP Company, Winona, Minn. and designated as 385 TFE 15EM. The shaft bearing 60 preferably is made of nylon 6/6 with 15% polytetrafluoroethylene and 30% carbon fiber conductive material, as manufactured by LNP Engineering Plastics, Malvern, Pa. and designated RCL 4036FR. The shafts 56 and 58 are steel for conducting any charges to ground potential. As mentioned earlier, the shaft 58 is electrically floating so that the carriage 54 and the spherical bearing 60, being made of conductive plastic material, provide a static charge dissipative path through the carriage and through the shaft 56 to the printer grounding system. The bearings 61 and 62 include self-oiling bronze inserts or bushings, as 112 and 114 in FIGS. 2 and 4.

The discharge path for any charges that are generated by reason of the impact printing of the print head 22 is from the print head, through the carriage 54, through the bronze inserts 112, 114 (FIGS. 3 and 4) in bearings 61 and 62 and through the shaft 56 to ground potential. Additionally, the path of discharge or grounding includes the motor 48, a mounting plate 59 for printed circuit boards, an input/output connector shell 63, and an interconnect cable shield 65.

Figure 5:
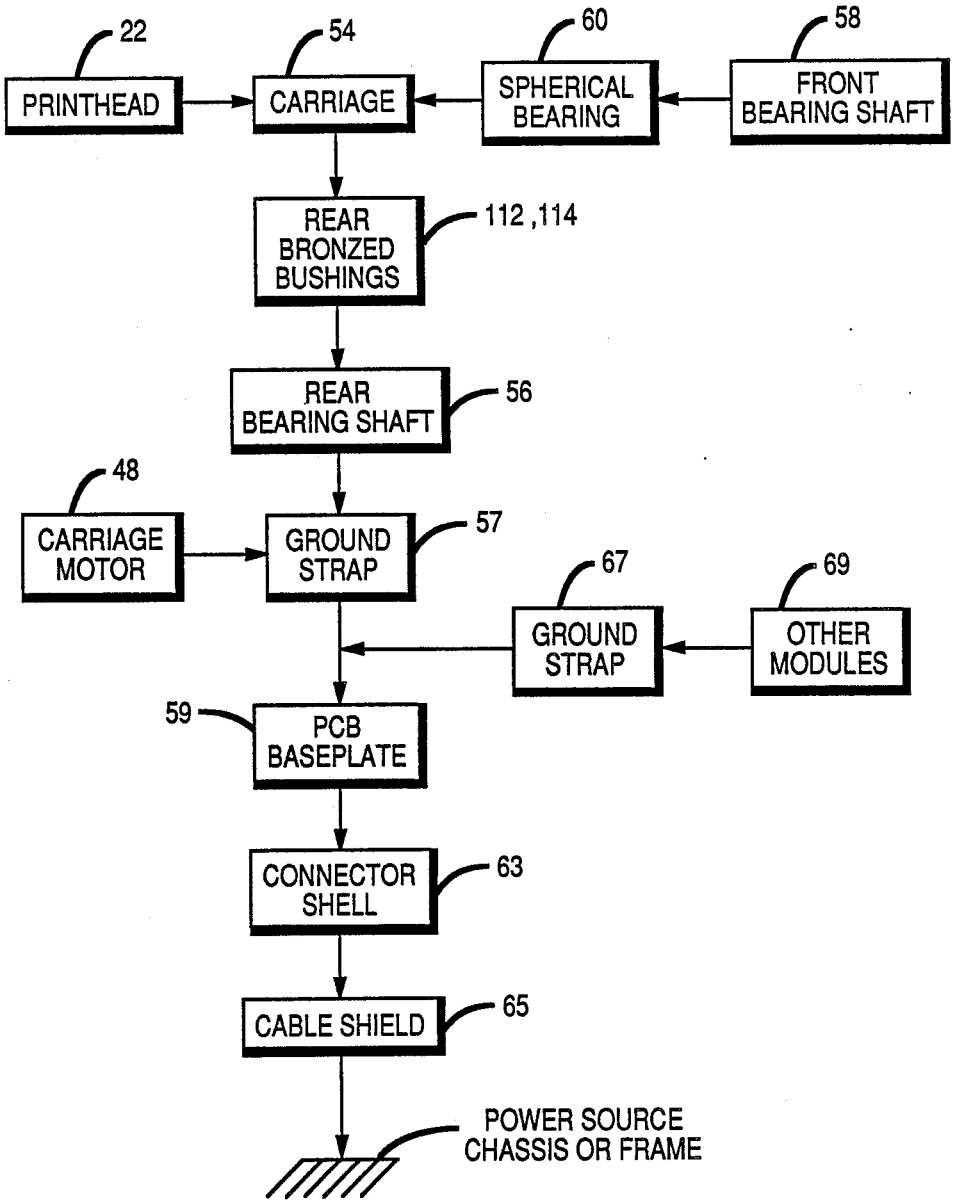
FIG. 5 is a block diagram of the various elements included in the charge dissipative path.

FIG. 5 is a block diagram of the various elements and illustrating the path of discharge of any charges built up from print wire impact or by human contact. The print head 22 is carried by and secured to the carriage 54 with the shaft 58 being connected in the grounding path to the carriage through the spherical bearing 60. The carriage 54 is bonded to the shaft 56 through the bronze bushings 112, 114 of shaft bearings 61 and 62. The motor 48 is bonded to a strap 57 in contact with the shaft 56, in turn, connected with a baseplate 59 carrying one or more printed circuit boards. The baseplate 59 is bonded to the I/O connector shell 63, in turn, connected to the cable shield 65 and to the chassis of an appropriate printer controlling device which includes the power source for the printer 12. Other modules 69, such as a receipt/slip module, are bonded by means of a strap 67 to the shaft 56 (FIG. 2).

It is thus seen that herein shown and described is a carriage on which is installed a dot matrix print head. The printed circuit card is received in a receptacle that is affixed to a printed circuit board. A flat, flexible cable is affixed to the printed circuit board. The carriage is made of a conductive material that provides a static charge dissipative path from the print head to the bronze inserts of the bearings that journal the carriage supporting shaft and then to ground potential. The apparatus and arrangement enable the accomplishment of the objects and advantages mentioned above, and while the preferred embodiment of the invention has been disclosed herein, variations thereof may occur to those skilled in the art. It is contemplated that all such variations nor departing from the spirit and scope of the invention hereof are to be construed in accordance with the following claims.

What is claimed is:

1. A printer for serial printing of indicia on record media, comprising a printer frame, a print head carriage, a print head secured to said carriage, and shaft means secured to said printer frame and supporting said print head carriage for transverse movement along said shaft means in printing operations, said print head carriage including bearing means and said carriage being made of a conductive material comprising polycarbonate with polytetrafluoroethylene and carbon material wherein said print head is bonded through said bearing means and through said shaft means to the ground potential of said printer.

2. The printer of claim 1 wherein the polytetrafluoroethylene is about 15% and the carbon is about 30% of the total material of said print head carriage.

3. In a printer for printing of indicia on record media, said printer having a grounding system, a print head movable along guide means in transverse direction on said printer, the improvement comprising a print head carriage to which said print head is secured and including bearing means engaging said guide means, said print head carriage being made of a conductive material comprising polycarbonate with polytetrafluoroethylene and carbon material wherein said print head is bonded through said bearing means and said guide means to the ground potential of said printer.

4. In the printer of claim 3 wherein the polytetrafluoroethylene is about 15% and the carbon is about 30% of the total material of said print head carriage.

* * * * *